US006499931B1

(12) United States Patent
Garrett, Jr. et al.

(10) Patent No.: US 6,499,931 B1
(45) Date of Patent: Dec. 31, 2002

(54) RECYCLING VEHICLE

(76) Inventors: Billy J. Garrett, Jr., 120 Glenridge Cir., Greenwood, SC (US) 29646; William L. Aldridge, 101 Pine Tree Dr., Simpsonville, SC (US) 29680

( * ) Notice: Subject to any disclaimer, the term of this patent is extended or adjusted under 35 U.S.C. 154(b) by 0 days.

(21) Appl. No.: 09/614,831

(22) Filed: Jul. 12, 2000

Related U.S. Application Data

(60) Provisional application No. 60/143,349, filed on Jul. 12, 1999.

(51) Int. Cl.[7] ..... B65F 3/00; B65F 3/08; B65F 3/12; B65F 3/14

(52) U.S. Cl. ..... 414/406; 414/407; 414/409

(58) Field of Search ..... 414/406, 407, 414/409; 100/100

(56) References Cited

U.S. PATENT DOCUMENTS

| | | | | |
|---|---|---|---|---|
| 2,961,977 A | * | 11/1960 | Coleman | 100/100 X |
| 4,113,125 A | * | 9/1978 | Schiller | 414/406 |
| 4,242,953 A | * | 1/1981 | St-Gelais | 100/100 |
| 4,941,796 A | * | 7/1990 | De Filippi | 414/409 |
| 5,116,184 A | * | 5/1992 | Pellegrini | 414/406 |
| 5,215,264 A | * | 6/1993 | Lundquist | 241/37.5 |
| 5,275,522 A | | 1/1994 | Garrett, Jr. et al. | 414/407 |
| 5,395,061 A | * | 3/1995 | Merklinger | 241/101.742 |
| 5,511,687 A | | 4/1996 | Garrett, Jr. et al. | 414/407 |
| 5,833,428 A | * | 11/1998 | Szinte | 414/408 |
| 5,927,626 A | * | 7/1999 | Shinjo et al. | 241/101.742 |

FOREIGN PATENT DOCUMENTS

| | | | |
|---|---|---|---|
| DE | 4232011 | * 10/1993 | 414/406 |
| JP | 8-26408 | * 1/1996 | 414/406 |

* cited by examiner

*Primary Examiner*—Steven A. Bratlie
(74) *Attorney, Agent, or Firm*—Michael A Mann; Nexsen Pruet Jacobs & Pollard LLC

(57) ABSTRACT

The vehicle for collecting, sorting and reducing the volume of recyclable wastes and regular household and commercial garbage includes a large container with plural compartments mounted to the exterior of the vehicle includes a lifting mechanism for lifting the container to the top of the vehicle so that its contents can be dropped through chutes into plural bins. The lifting mechanism assures that the integrity of the sort of recyclables into each compartment of the container is maintained as the waste drops from the compartments through the chutes into individual bins. Between the chutes and the bins are crushers and shredders for reducing of volume of wastes deposited in the bins. Other wastes are placed in balers for baling. The bales of wastes are stored in a rack under the vehicle's housing. Crushing, shredding and baling not only reduces volume but allows the vehicle to collect wastes from more homes than without these on-board capabilities. The vehicle may optionally include a section for receiving and processing other organic wastes to reduce its volume.

18 Claims, 6 Drawing Sheets

RECYCLING VEHICLE

Applicant claims the benefit of the filing of U.S. provisional patent application Ser. No. 60/143,349, filed Jul. 12, 1999, which is incorporated herein by reference.

FIELD OF THE INVENTION

The present invention relates generally to recycling of household and commercial wastes. In particular, it relates to vehicles for collecting recyclables at curbside or at places of commerce.

BACKGROUND OF THE INVENTION

As a result of increasing concern for the environment and the efficient use of energy resources, there has been a growing interest in recycling of materials, especially recyclable components of household refuse. Among the types of materials that can be recycled are cardboard, chipboard, magazines, newspaper, plastics, glasses and metals. However, in order to recycle these materials efficiently, they have to be collected and carefully sorted. Recyclables may fall into any one of a dozen different categories. Glass, for example, may be clear, green or brown; plastics may be made of clear polyethylene (PET) or high density polyethylene (HDPE) or mixed plastics. Homeowners and business owners, even when highly motivated to recycle, have difficulty sorting recyclables into all the categories possible.

Another problem with collecting recyclables is the volume of materials. Glass, cardboard, newspaper, chipboard, magazines and plastic bottles are bulky. Metal cans can be crushed to some extent by the homeowner but still occupy a considerable portion of their original volume. Vehicles for transporting materials are limited by both space and weight, but with recyclables, the volume limits are reached well before the weight limits are reached. Each trip to haul wastes where the volume limits are reached well before the weight limits means that the vehicle is not being used effectively. Doubling the amount of weight on a load will significantly improve transportation economics but would have insignificant impact on fuel consumption.

Finally, the economics of recycling in general are fragile. In addition to transportation costs, a major component of costs is the cost of handling. Reducing handling helps to tip the economic factors in favor of recycling and may itself make the difference between a successful recycling program and one that fails.

There have been a number of approaches made to addressing the problem of recycling. The attempts based on having the consumer sort recyclables are impractical because, other than performing a very general sort, consumers are not sensitive to the different kinds of glass, metal, or plastic that need to be segregated. More recently, sorting is being done at a central sorting station. Recyclables are brought there and dumped onto large conveyors where technicians sort through them. The segregated recyclables are then taken to various destinations for reuse. This approach assures that the sorting is done correctly.

Thus there remains a need for a better way to collect and sort recyclables.

SUMMARY OF THE INVENTION

The present invention is a vehicle for collecting, sorting and reducing the volume of recyclables. The vehicle has three separate stations for recycling: at one station, eight types of recyclables are sorted by type and crushed and shredded; at the second station, balers are used to bale four types of recyclables; and, at the third, wastes are deposited and, optionally, processed to reduce volume. Altogether, there are twelve categories of recyclable's that are crushed, shredded and baleed. These include aluminum, bi-metals, three colors of glass, three types of plastics, newspapers, magazines, cardboard and chip board. It is also possible to use the first section to receive cardboard or to bale cans and plastics.

At the first section, a worker or technician sorts the homeowner's recyclables and possibly regular household wastes into a large container with eight compartments, one compartment for each of the eight primary categories. Between stops and whenever the vehicle is in motion, the container is covered with netting to prevent any recyclables from falling out. Once filled, the container is lifted up the back of the vehicle and part way across the top. As it is moved across the top of the vehicle, a hatch in the roof of the housing is opened allowing the contents of the container to fall into the appropriate bins in the first section of the vehicle. The recyclables fall through chutes to the bins. Each chute is dimensioned to receive the contents of one full compartment of the container. Below the chutes and above the bins are devices that crush or shred the recyclables so that, by the time they fall into the bins, their volume is considerably reduced. After the container is emptied into the chutes, it is moved rearward across the top of the vehicle and back down for re-loading by the technician.

The four categories of baleable waste are taken to the second section of the vehicle, sorted by type into one of four baler bins, and then baleed. When a baler has finished binding each bale, the door to the baler is opened, which automatically kicks the bale out of the baler bin, and then it is dropped from the baling area into a rack that is slung underneath the mid-section of the vehicle.

The third section enables the present vehicle to accept all types of household wastes, including garbage. In a preferred embodiment, the garbage is compacted in the third section or processed in some other way, such as incineration, to reduce its volume.

The combination of volume reduction and sorting in the same vehicle is a major advantage of the present invention. Not only does this permit the vehicle to collect more recyclables before having to return to the central collection station, but it reduces handling. Wastes do not have to be taken from collection bins to crushers and shredders at the central station or at their final destination; rather, they are crushed and shredded when deposited into the bins on the vehicle.

Another feature of the present invention that is important is the combination of balers and crusher/shredders on the same vehicle. This combination means that the present vehicle can collect and prepare all categories of recyclable waste for delivery to their respective recycling facility.

The baler rack is still another feature of the present invention, allowing the baleed waste to be stored on the vehicle, preferably under the baler section out of the way of those operating the baling area.

The various compartments and bins of the present vehicle are dimensioned for collecting residential waste efficiently, another feature of the present invention. Some bins and compartments are larger than others because of variations in the volume of waste of different categories. In general, the bins and compartments are sized for the anticipated volume of waste they are expected to receive.

The closed system of the present invention is a particular feature that it prevents waste particulate created from the volume reduction process from being blown or falling off the vehicle as it goes about its business.

Other features and their advantages will be apparent to those skilled in the art of recycling vehicle design from a careful reading of the Detailed Description of Preferred Embodiments, accompanied by the following drawings.

BRIEF DESCRIPTION OF THE DRAWINGS

In the figures.

DETAILED DESCRIPTION OF PREFERRED EMBODIMENTS

Figure 1:
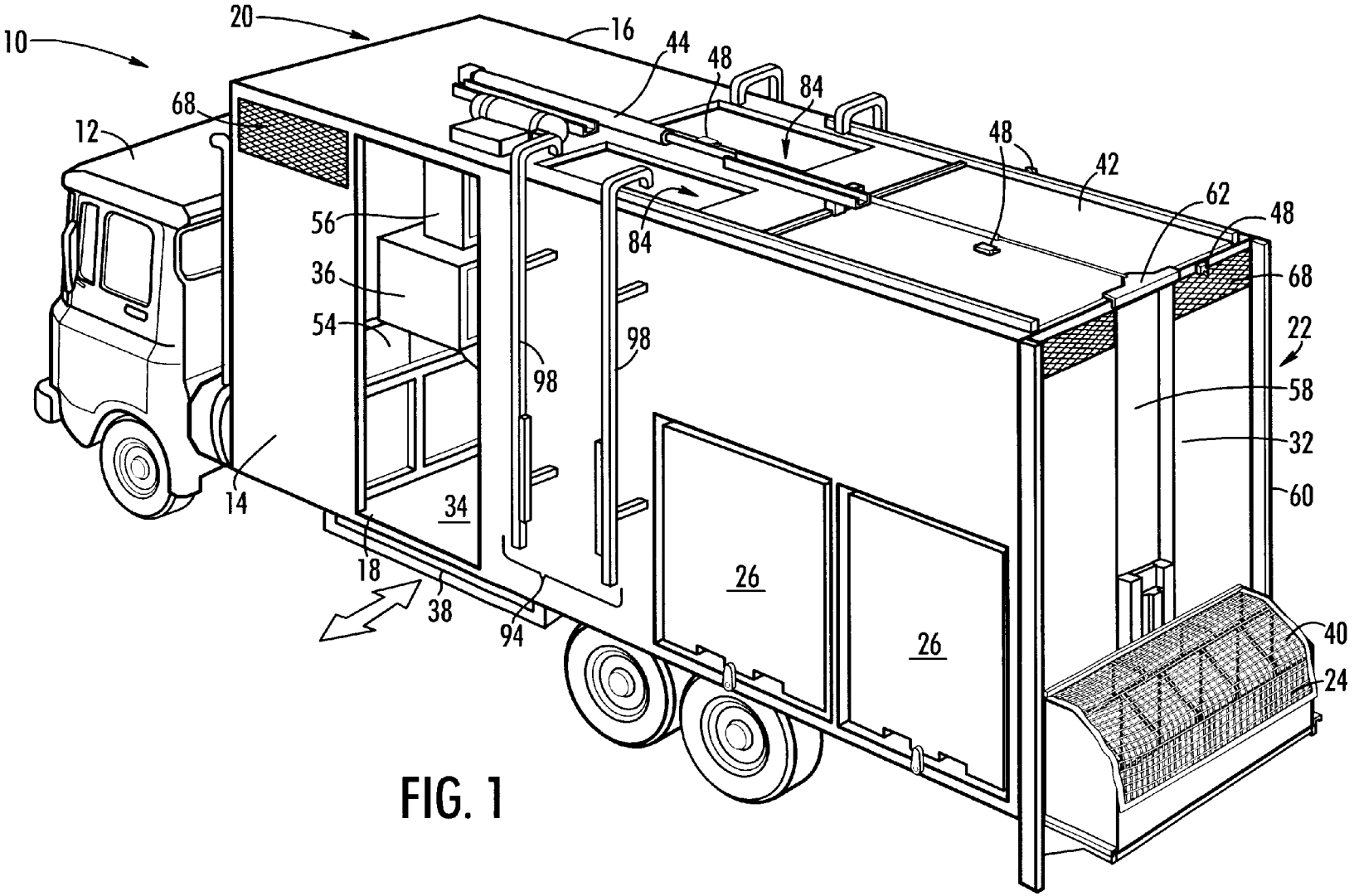
FIG. 1 is a perspective view of a recycling vehicle according to a preferred embodiment of the present invention.
Figure 2:
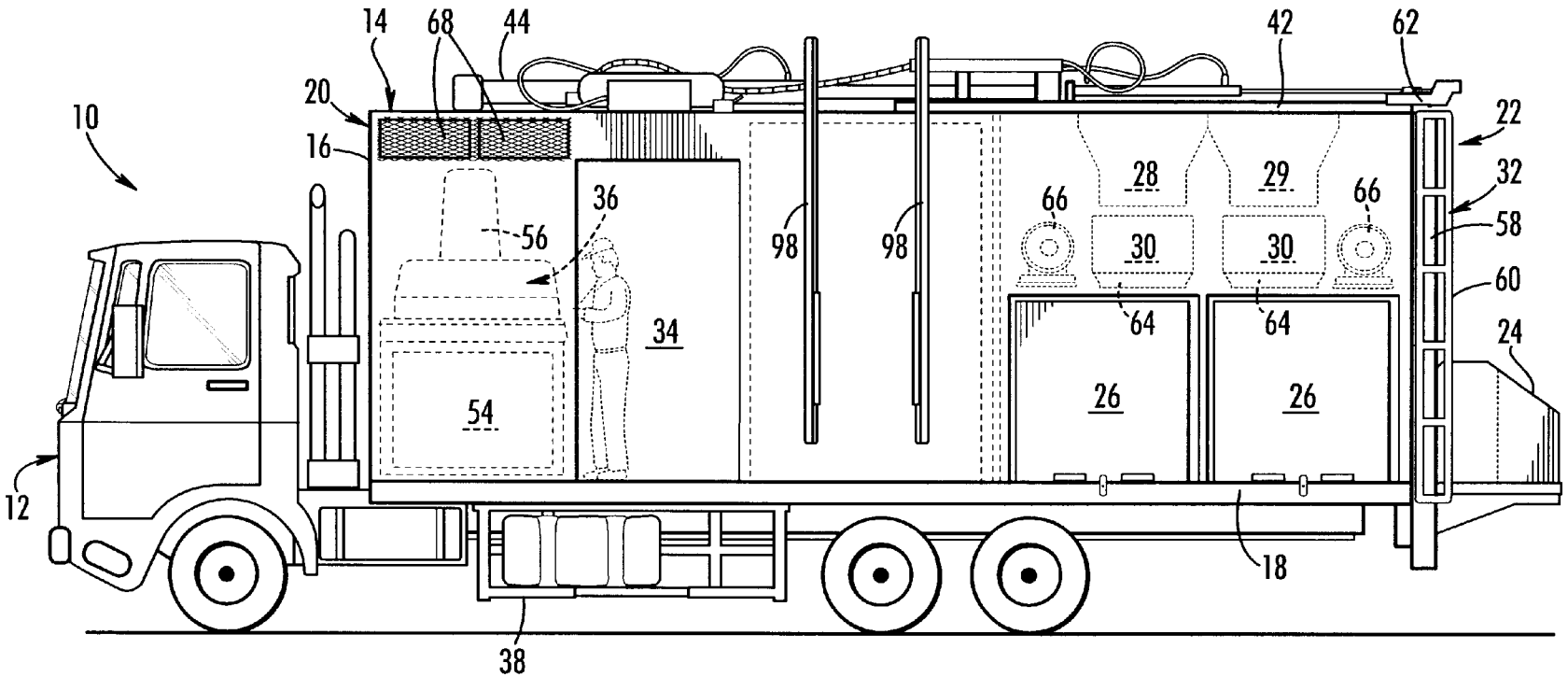
FIG. 2 is a side view of the recycling vehicle of FIG. 1 showing the balers, crushers, and shredders according to preferred embodiment.

The present invention is a vehicle designed to facilitate recycling of certain components of household refuse. These components include glass, plastic, aluminum, bi-metals, paper, cardboard, magazines, and chip board and are referred to herein as "recyclables". It is also possible to include household garbage as one of the categories. The vehicle not only permits collecting and sorting of these recyclables by type when they are picked up at curbside, but it reduces the volume of them and deposits them into individual bins that can serve as shipping containers. These individual bins are easily off-loaded with a fork lift and loaded directly onto trucks destined for facilities where these individually sorted materials can be used as a resource. These facilities are referred to herein as recycling facilities and are places where products are made that incorporate or use the collected recyclables.

Referring now to the figures, the present vehicle, generally referred to by reference number 10, includes a tractor 12, and a housing 14 on a frame 18 and has a front section 20, a mid-section 21 and a back section 22. Back section 22 includes a large external sorting container 24, internal bins 26, crushers 28, shredders 29 and chutes 30. Back section 22 also includes a lifting mechanism 32 for moving container 24 to the top of vehicle 10 and over the crushers 28 and shredders 29 for depositing recyclables into bins 26.

Front section 20 is a baling station 34 including balers 36 in a baling station and bale rack 38. Mid-section 21 includes a container 78 for receiving wastes and, optionally for processing the received wastes for volume reduction, such as by compaction.

Container 24 is divided into eight compartments 40, three on one side and five on the other. These compartments are intended to receive the eight categories of glass, plastics and metals. The size of each compartment 40 does not need to be uniform but should be sized based on the average ratios of the volumes of each category generated. For example, if twice as much volume of ABS plastics as aluminum cans is generated on the average by households, then the compartment 40 for ABS plastics should be twice the size of the compartment 40 for aluminum cans. As packaging technology evolves, these ratios may change. Consequently, from time to time the relative sizes of the compartments may need to be adjusted accordingly. Establishment of optimum sizes is a simple, straight-forward process of surveying the discarded wastes from a representative neighborhood where the present vehicle 10 will be operating.

Optionally, container 24 may include a full width trough (not shown) to facilitate the hand sort.

At the top of housing 14 is a hatch 42 operated by a telescoping hydraulic ram 44 that will open and close the floor 46 of container 24. Ram 44 is powered by a separate generator (not shown) or from the power takeoff of the vehicle. Limit switches 48 prevent ram 44 from moving hatch 42 and floor 46 too far. Operation of auxiliary hydraulic equipment from a power take off or generator is well known, especially to those skilled in heavy equipment design and waste collection vehicle design.

At the back section 22 of housing 14 is a lift mechanism 32 that holds container 24 and lifts it vertically so that floor 46 clears hatch 42 and can be moved laterally from back section 22 toward front section 20, as best seen in FIGS. 3 and 4. When container 24 has been moved far enough so that it is directly over crushers 28 and shredders 29, hatch 42 is withdrawn forward to uncover crushers 28 and shredders 29. Then floor 46 is moved forward to allow the contents of compartments 40 to fall from container 24 into crushers 28 and shredders 29.

Crushers 28 and shredders 29 have tapered entrances so that they slow and control the flow of recyclables. Crushers and shredders 28,29, crush and shred the recyclables and deposit them through chutes 30 in bins 26. The correspondence of the number and arrangement of compartments 40, chutes 30 and bins 26 is such that the contents of each compartment falls into a single chute and thence into a single bin so that the integrity of the sort by the technician is preserved; that is, once the recyclables are sorted by the technician, there is no mixing of the wastes even as they are handled together. Each bin 26 thus will have only one type of glass or plastic or metal and cross contamination of the recyclables is minimized if not eliminated.

Figures 3A, 3B, 3C:
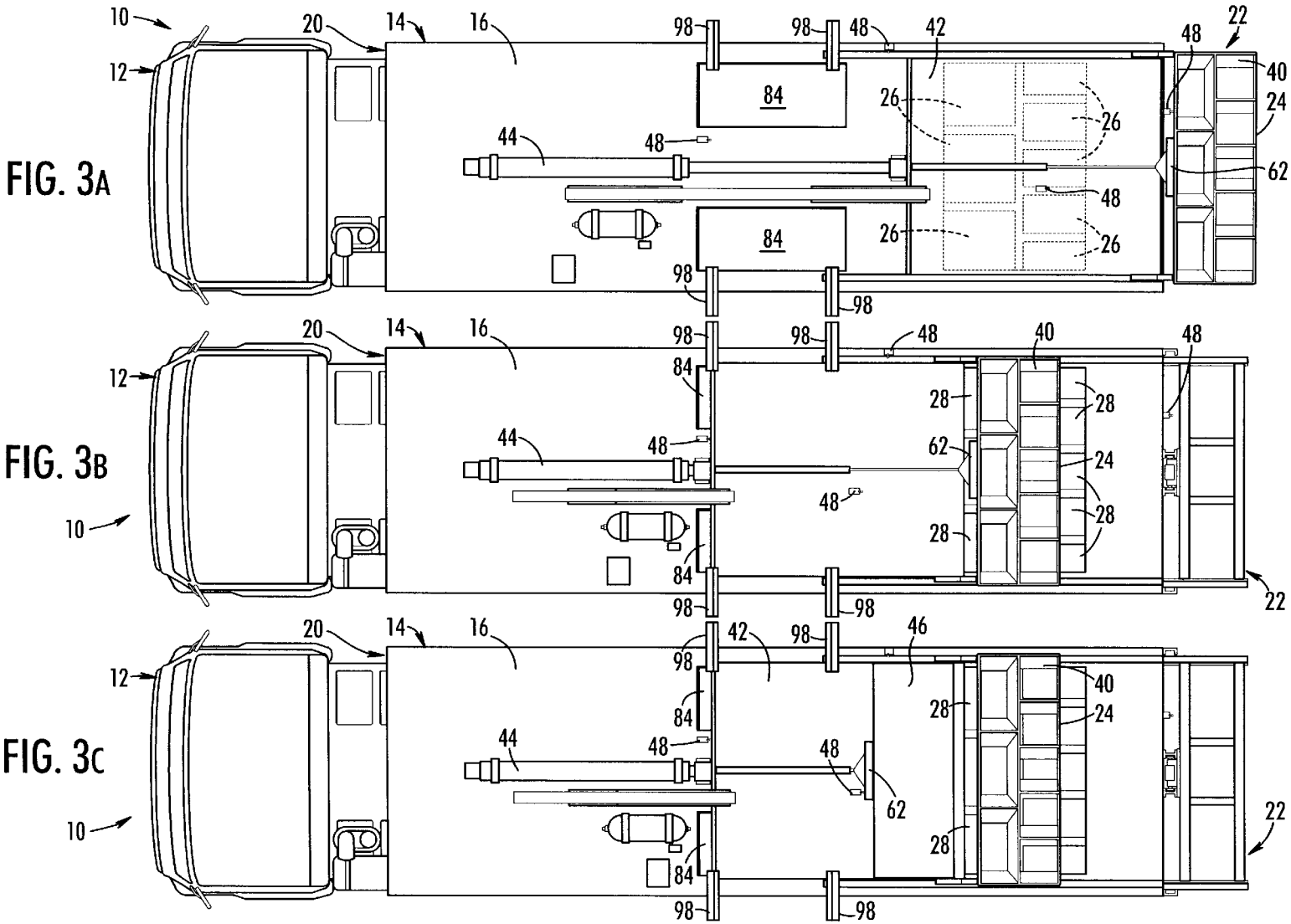
FIGS. 3A, 3B and 3C show top views of the present recycling vehicle with the hatch closed and opened and with the floor of the container closed and opened, according to a preferred embodiment of the present invention.

The movement of the recyclables in container 24 to bins 26 is illustrated in FIGS. 3 and 4. In FIG. 3A (in which the hydraulic cables have been eliminated to simplify the drawings) hatch 42 is shown in the closed position. The eight bins 26 are shown in ghost through hatch 42. FIG. 3B shows container 24 directly over bins 26 with hatch 42 opened by movement of one section of telescoping ram 44. In FIG. 3C, floor 46, that holds the contents of container 24 in place is pulled away by the other section of telescoping ram 44, allowing the contents of container 24 to fall.

Figure 4B:
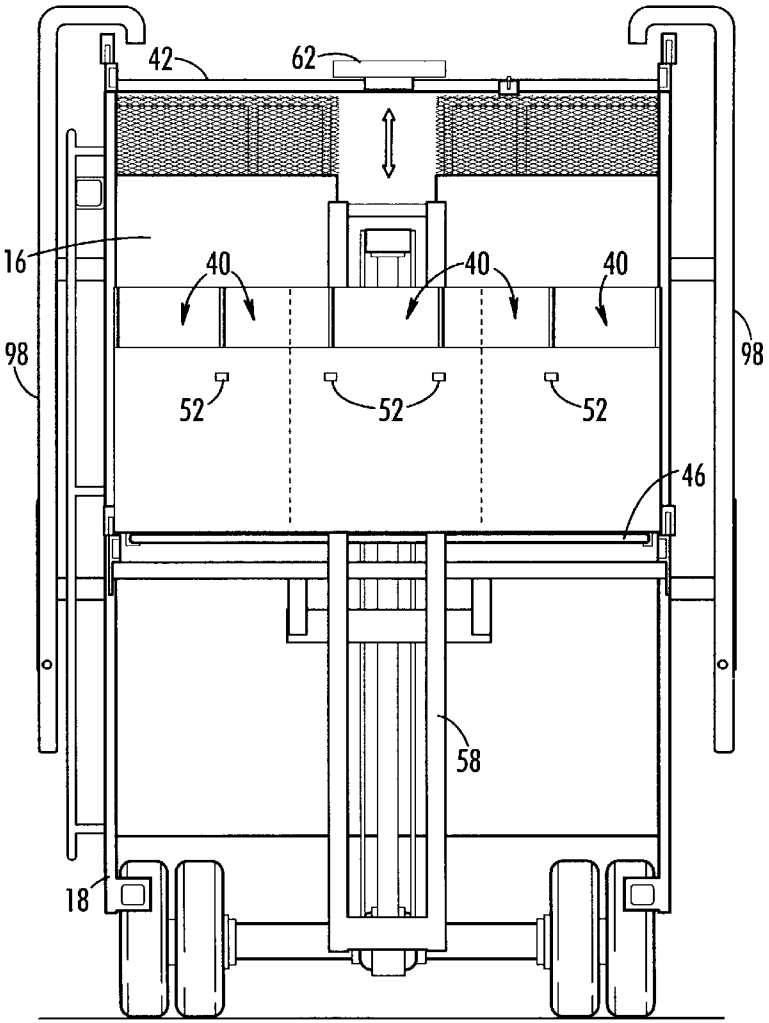
FIGS. 4A, 4B and 4C show a back view of a recycling vehicle according to a preferred embodiment of the present invention, with the large container shown in its lowermost position, in an intermediate position and in its topmost position.
Figure 4A:
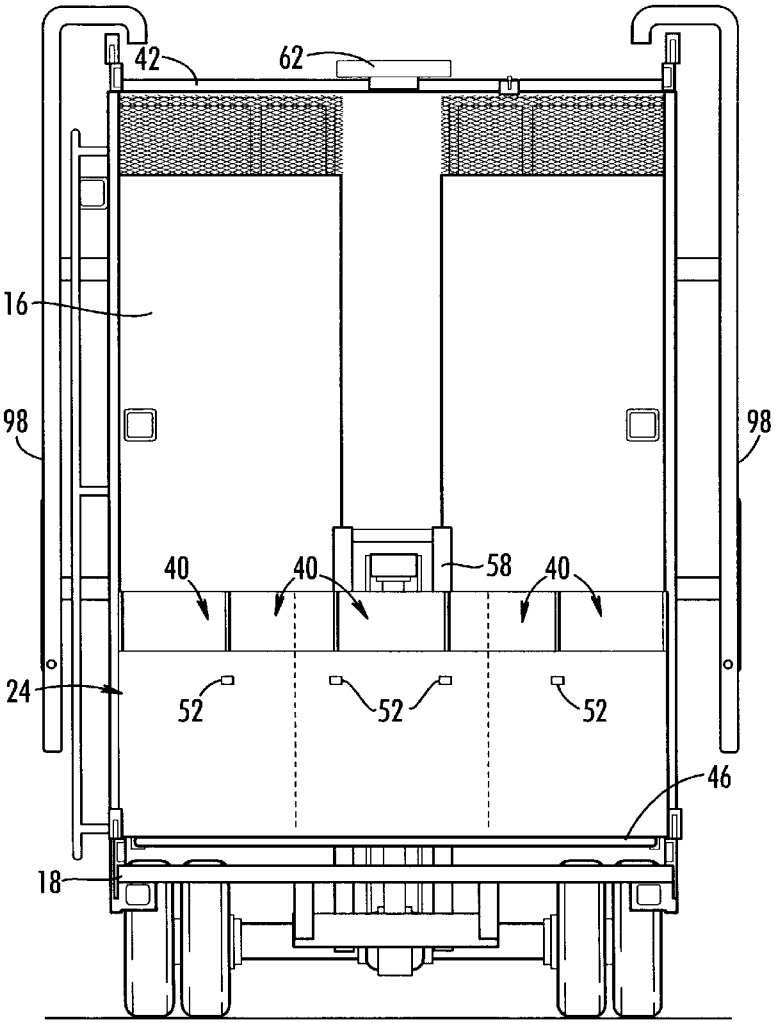

FIGS. 4A and 4B show back portion 22 of vehicle 10. In FIG. 4A, external sorting container 24 is shown in its lowermost position. FIG. 4B shows external sorting container 24 in an intermediate position and being raised to the top of vehicle 10. A mast 58 such as would be found on a fork lift can be used to lift external sorting container 24 using chain link belts and sprockets. Mast 58 is also preferably hydraulically operated from either a separate generator or the vehicle's power take off. Rails 60 on either side of back 20 of vehicle 10 help guide container 24 as it is raised and lowered.

Figure 4C:
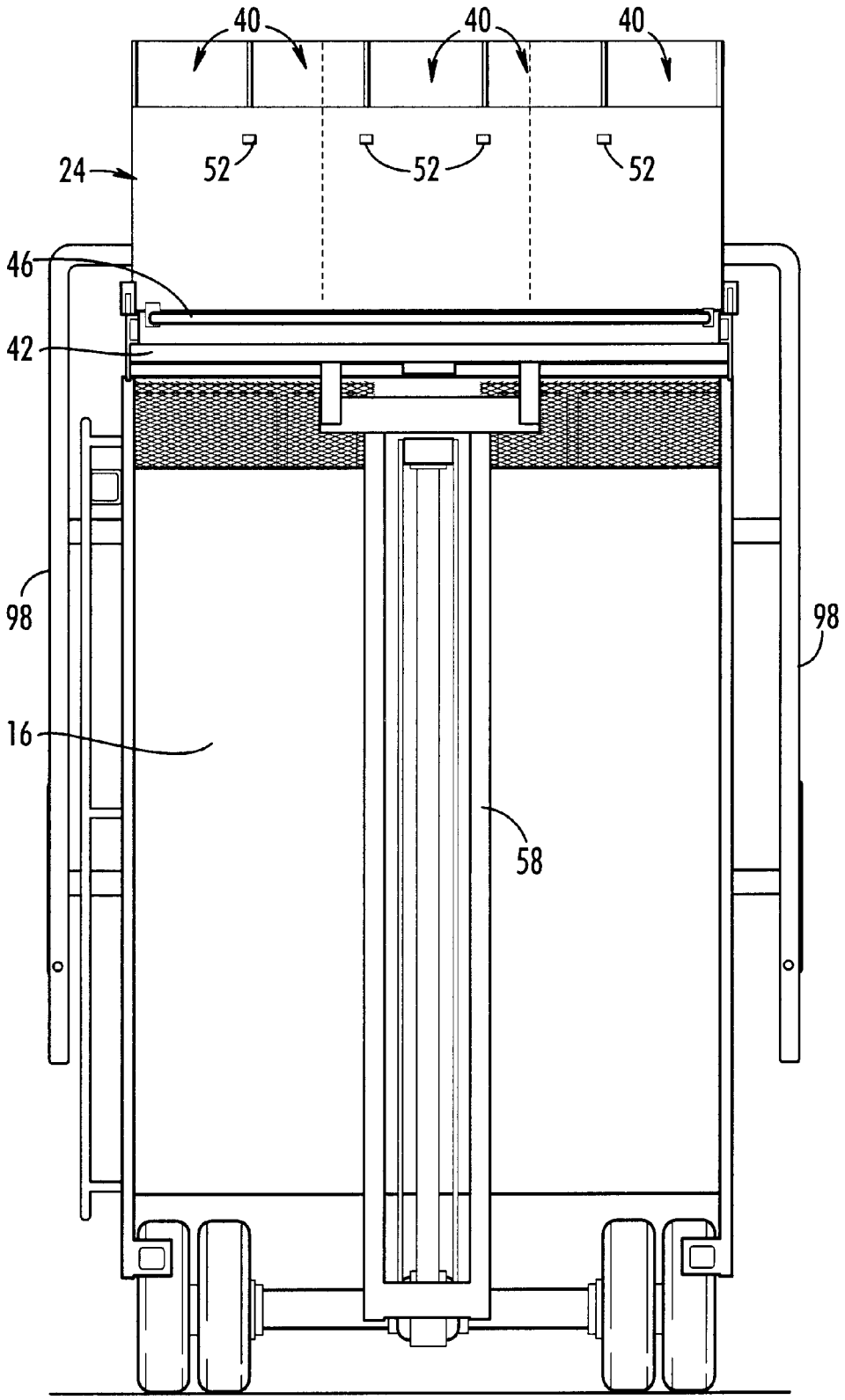

FIG. 4C shows container 24 in its highest position. Also visible in FIG. 4C is floor 46 and hatch 42. A catcher 62 at the end of telescoping ram 44 catches floor 46 of container 24. Container 24 must be lifted just high enough so that floor 46 clears hatch 42. It will take just under two minutes for the vehicle to cycle through one time lifting container 24 on the rear section, traversing the top of the vehicle, and dumping the recyclables into the chutes and crushers/shredders. The lift container 24 stores between 25 and 40 households before dumping is necessary. Typically, sixty-three households can be serviced in one hour.

In use an operator or technician would receive recyclables at curbside, sort the recyclables into 12 categories including three colors of glass (clear, green and brown), three types of plastic (PET, HDPE and mixed plastics), aluminum and bimetals, newspapers, magazines, cardboard, and chip board. These may be placed at curbside by the homeowner in any variety of formal or informal containers and bags. Hooks 52 on containers 24 facilitate sorting by allowing the technician to hang plastic boxes containing recyclables from the homeowner on the back of container 24 during the sort. Also, bags may be used instead of boxes with a trough mechanism attached to lifting container 24.

The glass, plastic and metals are placed by the technician into the appropriate compartments 40 of container 24. Once these components of the recyclable wastes are identified and sorted, the remainder are taken to baling station 34 in front section 20 of vehicle 10 and sorted for baling. Meanwhile, container 24 is lifted (as best seen in FIGS. 3 and 4) by lifting mechanism 32 to the top of vehicle 10, moved forward until directly over crushers 28 and shredders 29, whereupon hatch 42 is drawn back to expose them, and then floor 46 of container 24 is slid open allowing the segregated recyclables to fall into crushers 28 and shredders 29 where its volume is reduced before falling further through chutes 30 into bins 26. The cycle time for lift mechanism 32 and ram 44 is less than two minutes. By the time the wastes are in bins 26, their volume is greatly reduced—approximately 10:3.

In the event a homeowner wishes to pre-sort wastes, a container with divisions in it corresponding to those in container 24 can be provided that allows the technician to simply place the homeowner's container over container 24 and transfer the contents of the former to the latter. A system illustrating this process is shown and described in U.S. Pat. Nos. 5,511,687 and 5,275,522. If the present vehicle 10 is used in an area where homeowners are either required to pre-sort or where many do pre-sort, container 24 can be modified in size or height to make it easier to lift a second container over it.

Still other wastes—paper, cardboard, chipboard—are placed in balers for baling in front section 20. The bales of wastes are stored in a rack 38 under the vehicle's housing 14.

The newspapers, magazines, cardboard and the chip board are taken by the technician to baling station 34 in front section 20 where they are sorted into one of four baler bins 54. There are two balers 36 in baling section 34, each one with two bins 54 and one baling head 56. The four categories of baleable wastes: newspaper, magazines, cardboard and chip board are placed into the four bins 54. After baling, these recyclables are placed into bale rack 38 underneath housing 14. Bale rack 38 is slung under vehicle 10 between its rear wheels the wheels of tractor 12 and rolls between a retracted and secured position under housing 14 and an extended position where it extends from the side of housing 14. In the extended position, a bale can be pushed off the side of vehicle into the bale rack 38. Bale rack 38 can then be pushed back under housing 14 and latched in place. Bale rack 38 will hold three bales, enough for 500 homes' worth of paper recyclables. There is little reduction in volume of the paper recyclables but the baling makes handling and control easier, and the sorting by type avoids further handling and thus increases the value of the sorted recyclables when collected for recycling.

Any industrial baler can be used with the present invention. A suitable baler is made by Orwak model 9020 for example. Preferably, frame 18 of the vehicle under the balers 36 is reinforced to hold its weight and balers 36 are tied to the frame for support and stability. The preferred baler has two bins and one head that moves laterally over the bins from one to the other depending on which side the baling is to take place. Preferably there are two, twin-bin balers on each vehicle 10, providing four bins altogether, one for each type of baleable waste.

The crushers and shredder may similarly be made by any manufacturer of industrial crushers and shredders, such as those made by Prodeva.

The bins into which the recyclables are placed after being crushed and shredded are preferably made out of recycled plastics so that they are lightweight but still strong enough for use. These are equipped with forklift fork slots to facilitate lifting by a fork lift.

The present vehicle 10 can receive the recyclables waste from up to 500 households before it needs to be emptied. Five hundred households will produce two bales of recyclable paper.

The vehicle is a closed system, that is, there are barriers throughout to prevent recyclable wastes falling or blowing from the vehicle. Netting is used over container 24 and hatch 42 covers crushers 28 and shredders 29 when they are not receiving recyclables. Crushers 28 and shredders 29 have sufficient throat size to receive a full compartment's 40 of recyclables inside housing 14. Fiber guides 64 help to keep the output of chutes 30 moving into the right bins 26.

Figure 5:
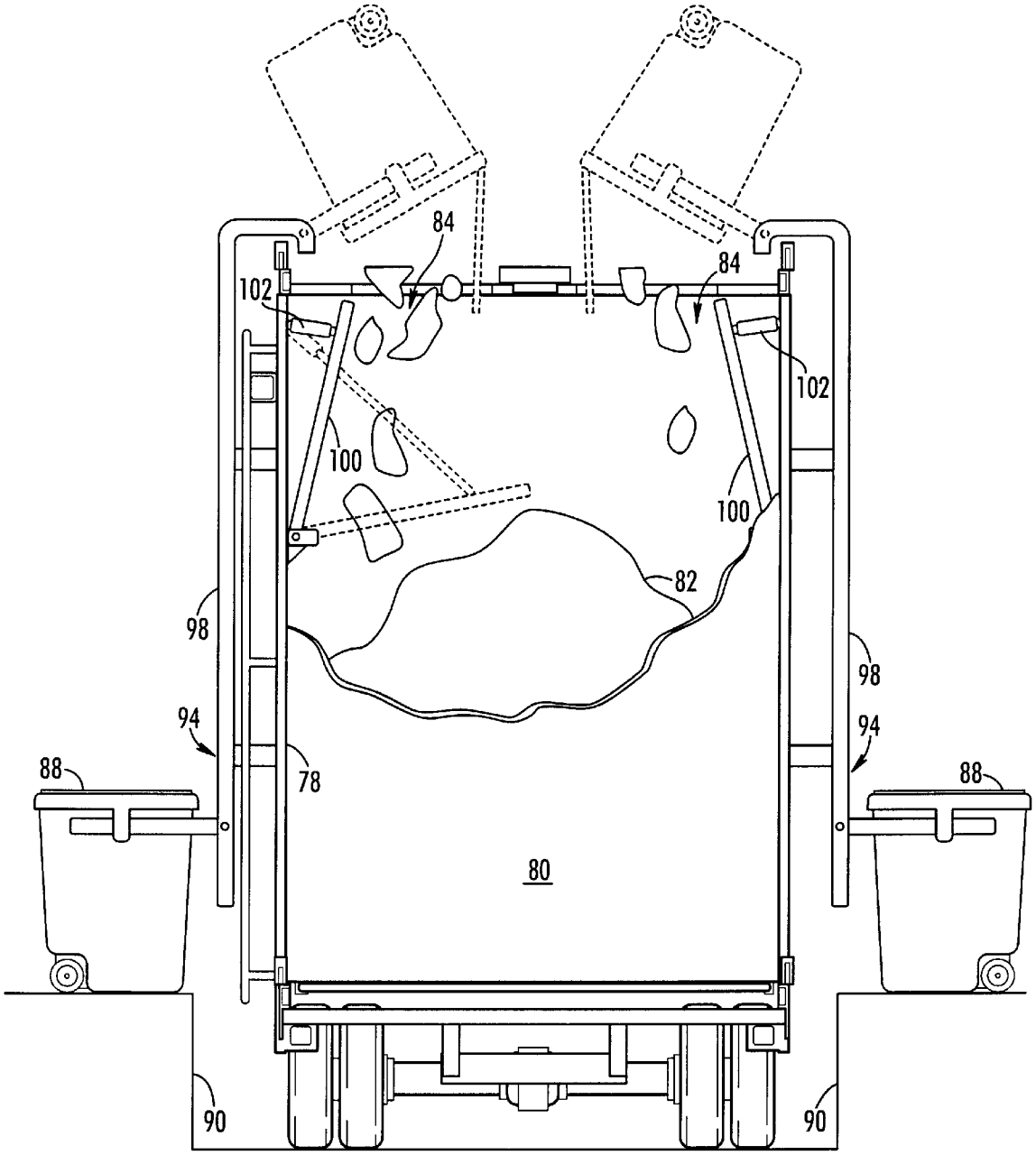
FIG. 5 is a cross sectional view of the third section of the present invention showing the depositing of wastes from a curbside container into the interior of the third section.

FIG. 5 illustrates one embodiment of mid-section 21, which is designed to receive wastes from a household that do not fall into any of the other categories but are nonetheless organic or largely organic. This section is generally not intended for receipt of such items as car batteries, old tires, broken appliances, etc. Mid-section 21 has an interior 80 for receipt of waste 82 through at least one opening 84 in housing 14, preferably through the top of housing. Waste 82 is accumulated in curbside containers 88 by the homeowner and placed near the curb 90 on a date scheduled for collection of wastes 82. A lifting mechanism 94 operated from within the cab of tractor 12 or from the exterior of housing 14 grips container 88 and lifts it up the side of housing 14 via a rail system 98, inverting it at the top of housing so that its contents are dumped through opening 84. Lifting mechanism 94 can be operated using a chain link system much like that shown in FIGS. 4A–4C.

Opening 84 may have a covering (not shown) that is manually or automatically operated by any convenient means, such as by a spring mechanism or an electrical or hydraulic mechanism.

On the interior 80 of mid-section 21 is a mechanism for processing the wastes 82 such as a pair of plates 100 that are made to press against wastes 82 by hydraulic cylinders 102 to compact them. Alternatively, wastes can be emptied into a hopper leading to an on-board incineration system with suitable filters that would permit the wastes to be reduced to a carbon residue, except for small metallic components and other non-incinerable components.

Power for the various components can be derived from a small electric generator located, for example, above the cab of tractor 12, or from the power take off of tractor 12 connected to a shaft running under frame 18 which would operate the hydraulic pumps required for the various power components of vehicle 12.

It will be apparent to those skilled in the art of recycling that many modifications and substitutions can be made to the preferred embodiments described above without departing from the spirit and scope of the invention, defined by the appended claim.

What is claimed is:

1. A vehicle, comprising:

a frame;

a housing covering said frame, said frame having an opening;

a movable hatch covering said opening;

a container having plural compartments carried by said frame exterior to said housing;

plural bins carried by said frame within said housing;

means for depositing the contents of said container into said plural bins through said opening so that the contents of each compartment of said container falls into a single bin;

means carried by said frame within said housing and in spaced relation to said plural bins for reducing the volume of wastes falling into said plural bins;

a baler carried by said frame within said housing, said baler capable of baling wastes; and a rack carried by said frame for holding bales of waste.

2. The vehicle as recited in claim 1, further comprising means for processing said wastes to reduce volume of said wastes.

3. The vehicle as recited in claim 2, wherein said processing means includes means for compacting said wastes.

4. The vehicle as recited in claim 1, wherein said rack is rollably carried under said frame and rolls between a retracted and an extended position.

5. The vehicle as recited in claim 1, wherein said volume reducing means is selected from the group consisting of a shredder, a crusher and combinations thereof.

6. The vehicle as recited in claim 1, wherein said depositing means includes:

a lift mechanism carried by said housing, said lift mechanism adapted to lift said container;

a hatch carried by said housing; and means for opening said hatch when contents of said container are to be deposited into said plural bins.

7. The vehicle as recited in claim 1, wherein said rack is dimensioned for holding two bales.

8. The vehicle as recited in claim 1, wherein said bins and said rack are dimensioned to receive wastes from approximately 500 homes.

9. A vehicle for collecting recyclable wastes, said vehicle comprising:

a tractor, a frame pullable by said tractor;

a housing carried on said frame, said housing having an opening formed therein, a front section having a baler for baling balable wastes, and a back section having a container with plural compartments for receiving sorted wastes, said frame having a rack for holding bales of waste, wherein said back section has plural bins for receiving sorted wastes from said container;

a hatch carried by said housing, said hatch being located over said opening of said housing,;

a lift mechanism carried by said housing for lifting said container; and means for opening said hatch when said lift mechanism lifts said container to said hatch for depositing said sorted wastes into said plural bins.

10. The vehicle as recited in claim 9, wherein said housing has a mid-section between said front section and said back section for receiving waste.

11. The vehicle as recited in claim 10, wherein said mid-section includes means for processing said wastes.

12. The vehicle as recited in claim 11, wherein said processing means includes means for compacting said wastes.

13. The vehicle as recited in claim 10, wherein said mid-section includes:

a lift mechanism for lifting a curbside container;

an opening formed in said housing; and a container contained within said mid-section for receiving wastes lifted by said lift mechanism and deposited through said opening.

14. The vehicle as recited in claim 9, wherein said rack is rollably mounted to said frame and rolls between a retracted position under said frame and an extended position.

15. A vehicle for collecting recyclable wastes, said vehicle comprising:

a tractor;

a frame pullable by said tractor;

a housing carried on said frame, said housing having an opening formed therein;

a movable hatch covering said opening;

means for moving said hatch;

a container carried by said housing and exterior to said housing, said container having plural compartments for receiving wastes sorted by type;

means for lifting said container to said hatch;

a baler carried by said housing for baling wastes; and a rack carried by said frame for holding bales of waste.

16. The vehicle as recited in claim 15 further comprising means carried by said housing for reducing the volume of said sorted wastes.

17. The vehicle as recited in claim 16, further comprising means carried by said housing for storing sorted wastes and baled wastes.

18. The vehicle as recited in claim 15, further comprising means carried by said housing for compacting wastes.

* * * * *